US005594477A

United States Patent [19]

Hilton

[11] Patent Number: 5,594,477

[45] Date of Patent: Jan. 14, 1997

[54] WET WIPER AND VACUUM PRIMER CONFIGURATION FOR FULL-WIDTH-ARRAY PRINTBAR

[75] Inventor: Brian S. Hilton, Webster, N.Y.

[73] Assignee: Xerox Corporation, Stamford, Conn.

[21] Appl. No.: 351,087

[22] Filed: Nov. 30, 1994

[51] Int. Cl.[6] ..... B41J 2/165

[52] U.S. Cl. ..... 347/30; 347/33; 347/42

[58] Field of Search ..... 347/29, 30, 32, 347/33, 42, 92, 93

[56] References Cited

U.S. PATENT DOCUMENTS

| | | | |
|---|---|---|---|
| 4,947,191 | 8/1990 | Nozawa et al. | 347/30 |
| 5,250,962 | 10/1993 | Fisher et al. | 347/30 |

FOREIGN PATENT DOCUMENTS

| | | | |
|---|---|---|---|
| 512799 | 11/1992 | European Pat. Off. | 347/42 |
| 585901 | 3/1994 | European Pat. Off. | 347/29 |
| 5-201028 | 8/1993 | Japan | 347/30 |

*Primary Examiner*—John E. Barlow, Jr.
*Attorney, Agent, or Firm*—Finnegan, Henderson, Farabow, Garrett & Dunner

[57] ABSTRACT

A priming device for a printbar having an array of print dies employs a vacuum nozzle shorter in width than one print die. At least one wet wiper blade is located adjacent to the vacuum nozzle and is used not only to moisten and wipe the channel outlets of the printbar, but during application of vacuum pressure in priming, the wiper blade serves to block the flow of air into adjacent channels, thereby eliminating cross-talk between groups of channels.

6 Claims, 2 Drawing Sheets

WET WIPER AND VACUUM PRIMER CONFIGURATION FOR FULL-WIDTH-ARRAY PRINTBAR

BACKGROUND OF THE INVENTION

The present invention relates to ink jet printbars. In particular, the invention relates to a priming device for such a printbar. Although suitable for any size printbar, the invention is particularly suited for use with a printbar comprising a full-page-width array of print dies.

Each print die contains an ink manifold providing ink to hundreds of minute capillary channels leading to the print face of the printbar. Each capillary channel is individually activated by heating a portion of the ink within the channel, thereby forming a small steam bubble which displaces and propels ink out of the channel onto a sheet of paper. Ink is supplied to each print die through sets of filters protecting the channels from contamination in the ink supply. When the printbar is filled with ink, ink will occasionally not pass through the filters and, therefore, not fill an individual print die with ink. Under other circumstances, the ink within a channel may dry or harden to the point of clogging the channel, preventing proper operation of the device. In either event, a priming operation is required to correct the flow of ink to those print dies or channels which are not functioning properly.

As a further example, ink jet printbars operate at high temperatures, often generating up to several hundred watts of heat across the printbar. Operating at these temperatures occasionally causes air ingestion into the system, requiring priming. These high temperatures may also cause air to come out of solution with the ink, resulting in the same problem. Further, rapid, repeated firing of a group of channel outlets may exceed the rate at which ink is supplied to those jets, again requiring priming. Moisture in the ink supply system may cause similar problems, requiring priming. Finally, clogging of the filters may occur during initial or refilling of the printbar ink supply, also requiring priming.

Previous priming systems have been proposed which use a vacuum conduit applied to the full width of the print die array, covering all the channel outlets along the print face. When suction is applied in these systems, however, ink is suctioned out of the channels indiscriminately, whether or not they require priming. Thus over the life of the device, significant quantities of ink are wasted during priming operations. Moreover, because suction must be applied to the full width of the print die array, strong vacuum pressure is difficult to maintain for each print die across the array.

Other priming systems have been proposed using a vacuum nozzle covering only a small group of channel outlets, where the nozzle is moved from one group of channels to another in succession. These systems suffer from "cross-talk" between groups of channel outlets in the same print die. When suction is applied to one group of channel outlets, air merely enters into an adjoining group, greatly reducing the vacuum pressure and thus the effectiveness of the priming operation.

Previous print bar systems have also used wiper blades to remove hardened and excess ink from the face of the print die array. These wiper blades are usually moistened to aid in dissolving any dried ink along the print die array. A single wet wiper or a group of wipers may be used in this capacity, and may be movably mounted to wipe across the width of the print die array. These wipers do not address the problem of clogged filters.

SUMMARY OF THE INVENTION

Accordingly, the present invention is directed to a printbar priming device that substantially eliminates the disadvantages of the described prior arrangements. The principle advantage of the present invention is the use of existing wiper blade structures to eliminate cross-talk between adjoining channels. This configuration significantly increases the efficiency of vacuum priming compared to previous methods. In addition, the invention can be implemented inexpensively, modifying existing structures already operating on the array of print dies.

Additional features and advantages of the invention will be set forth in the description with follows and, in part, will be apparent from the description, or may be leaned by practice of the invention. The objectives and other advantages of the invention will be realized and attained by the apparatus particularly pointed out in the written description and claims hereof, as well as the appended drawings.

To achieve these and other advantages, and in accordance with the purposes of the invention, as embodied and broadly described, the invention is a priming device for priming with ink a print bar having a plurality of print dies arrayed along a width of the printbar, each print die containing a plurality of channel outlets along a print face of the printbar, comprising a vacuum conduit movably mounted along the print face of the printbar, the vacuum conduit having a suction end opposite the channel outlets of the print dies and shorter in width than the width of the printbar. In addition, the invention includes a wiper blade movably mounted along the face of the printbar and opposite the channel outlets of the print dies, the wiper blade being shorter in width than the width of the printbar. When the suction end of the vacuum conduit is positioned opposite a first set of channel outlets of a one of the plurality of print dies, the wiper blade is positioned adjacent to one side of the suction end of the vacuum conduit opposite a second set of channel outlets of the one of the plurality of print dies such that when suction is applied to the suction end of the vacuum conduit opposite the first set of channel outlets the wiper blade substantially prevents air from entering the second set of channel outlets.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are incorporated in and constitute a part of this specification, illustrate one embodiment of the invention and, together with the description, serve to explain the objects, advantages, and principles of the invention.

In the drawings.

DETAILED DESCRIPTION OF THE PREFERRED EMBODIMENTS

Figure 1:
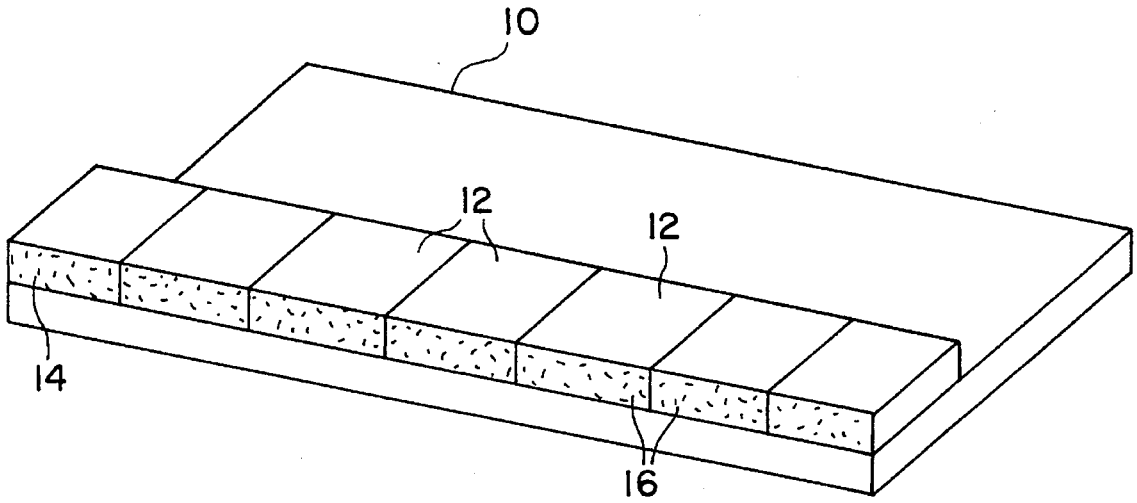
FIG. 1 is a perspective view of a printbar in accordance with the present invention.
Figure 2:
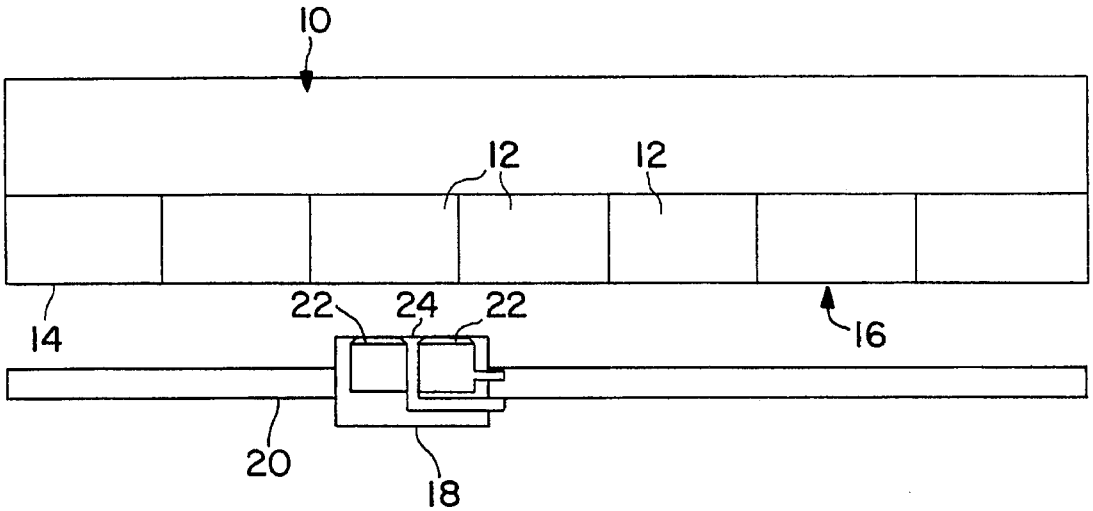
FIG. 2 is a top view of a printbar priming device in accordance with the present invention.

A priming device for priming with ink a printbar in accordance with the present invention includes a vacuum conduit operating on the print face of an array of print dies comprising the printbar. An exemplary embodiment of the printbar priming device of the present invention is shown in FIGS. 1 and 2. A full-page-width array printbar 10 includes an array of print dies 12 arranged along a print face 14. Each print die in the array includes a plurality of channel outlets 16 along the print face.

Figure 3:
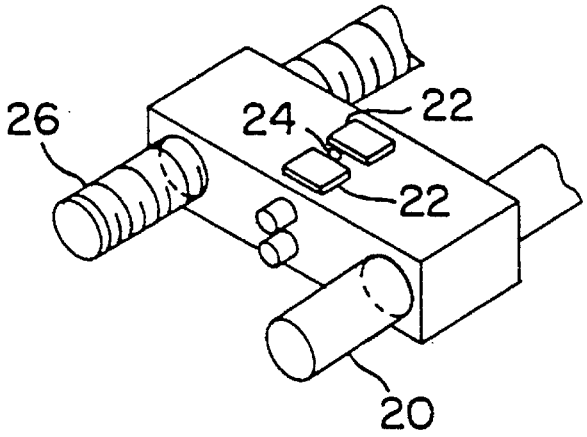
FIG. 3 is a perspective view of a wiper and vacuum carriage in accordance with the present invention.

The priming device of the present invention includes a means for movably mounting the vacuum conduit relative to the print face of the printbar. In the preferred embodiment, a maintenance carriage 18, shown in FIG. 2, is movably mounted along a guide rail 20 which spans the entire width of the print die array. The maintenance carriage, further depicted in FIG. 3, includes two wet wipers 22 on opposite sides of a vacuum nozzle 24 mounted therebetween. A lead screw 26 controls movement of the maintenance carriage across the width of the printbar. While two wet wiper blades are depicted in the drawings and described herein, for reasons which will become apparent, the invention is not limited to use of dual wiper blades, and a single wiper blade is effective in achieving the results of the present invention. Further, while the maintenance carriage is movably mounted in the preferred embodiment, the carriage can be stationary, with the printbar movably mounted.

In operation, the maintenance carriage 18 is moved along the print face 14 of the printbar 10 on guide rail 20, propelled by lead screw 26. The wet wiper blades and vacuum nozzle face the print face 14 and thus the channel outlets 16.

Figure 4:
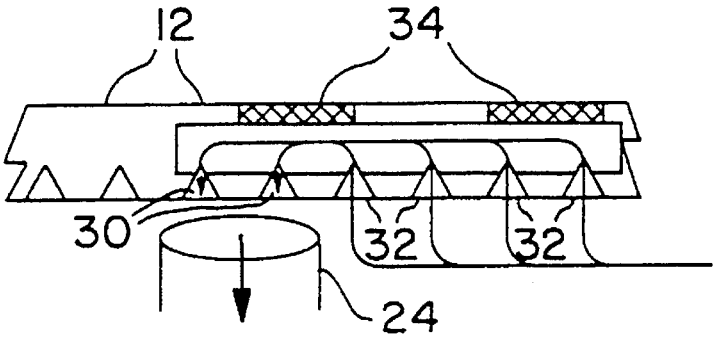
FIG. 4 PRIOR ART
FIG. 4 is a diagrammatic view demonstrating the inefficiencies of a vacuum primer operating as suggested in the prior art.

As shown in FIG. 4, in the absence of the wiper blade configuration of the present invention, a vacuum nozzle 24 facing a group of channel outlets 30 fails to draw ink from the filters 34 because of air entering adjacent channel outlets 32.

Figure 5:
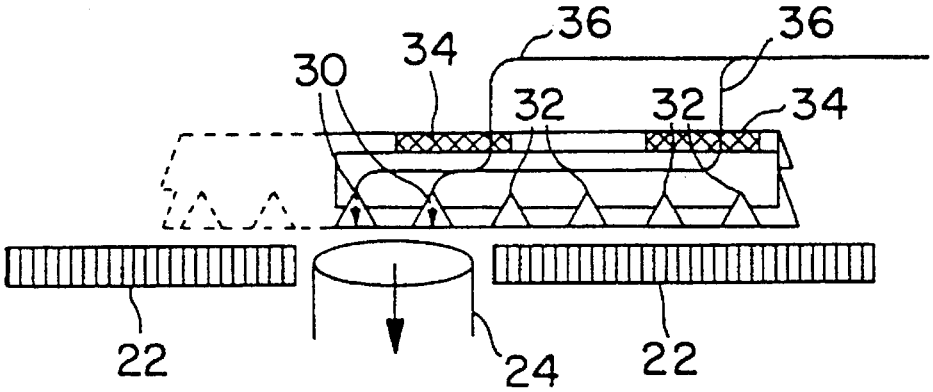
FIG. 5 is a diagrammatic view of a vacuum primer operating in accordance with the present invention.

FIG. 5, however, demonstrates the effectiveness of the present invention. In accordance with the invention, the vacuum nozzle 24 is mounted adjacent to at least one wiper blade 22 such that wiper blade 22 effectively blocks air from entering channel outlets 32 when suction is applied to channel outlets 30. As a result, ink is effectively drawn through filters 34 into the print die. Because the vacuum nozzle applies a vacuum to a small group of channel outlets, rather than all the channel outlets of the print die array, a substantial amount of vacuum pressure is developed. Further, because the vacuum nozzle is positioned immediately adjacent to at least one wiper blade, substantially all the vacuum pressure is applied and used to draw ink through the filters. Cross-talk between adjacent groups of channels is eliminated. Priming and wiping operations are also conveniently combined, inexpensively and efficiently.

FIGS. 4 and 5 are mere diagrammatic representations for purposes of illustrating operation of the present invention. In practice, the vacuum nozzle 24 is positioned opposite a significant number of channel outlets along the print face 14. The vacuum nozzle 24 may also be positioned opposite channel outlets belonging to more than one print die 12. In that event, wiper blades 22 would simultaneously prevent cross-talk from occurring in two different print dies.

While the depicted and preferred two wiper blades positioned on either side of the vacuum nozzle eliminate cross-talk, a single wiper blade is nevertheless effective at preventing substantial cross-talk and is included within the scope of the present invention. In addition, the printbar primed by the present invention need not be limited to the linear array of print dies depicted in FIG. 1 and diagrammatically represented in FIGS. 4 and 5. Various two- and three-dimensional arrays of print dies, staggered arrays, and large, uniform structure dies, are effectively primed by the present invention with minor modifications of the embodiment described above which would be known to one of skill in the art.

Thus it will be apparent to those skilled in the art that various modifications and variations can be made in the disclosed system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A priming device for priming with ink a printbar having a plurality of print dies arrayed along a width of the printbar, each print die containing a plurality of channel outlets along a print face of the printbar, comprising:

a vacuum conduit movably mounted along the print face of the printbar, the vacuum conduit having a suction end opposite the channel outlets of the print dies and shorter in width than the width of the printbar; and a wiper blade movably mounted along the face of the printbar and opposite the channel butlers of the print dies to wipe across the channel outlets, the wiper blade being shorter in width than the width of the printbar, wherein when the suction end of the vacuum conduit is positioned opposite a first set of channel outlets of a one of the plurality of print dies, the wiper blade is positioned adjacent to one side of the suction end of the vacuum conduit opposite a second set of channel outlets of the one of the plurality of print dies such that when suction is applied to the suction end of the vacuum conduit opposite the first set of channel outlets the wiper blade substantially prevents air from entering the second set of channel outlets.

2. The priming device of claim 1, further comprising a second wiper blade wherein when the suction end of the vacuum conduit is positioned opposite a first set of channel outlets of the one of the plurality of print dies, the second wiper blade is positioned adjacent to the other side of the suction end of the vacuum conduit along the width of the printbar and opposite a third set of channel outlets of the one of the plurality of print dies such that when suction is applied to the suction end of the vacuum conduit opposite the first set of channel outlets the second wiper blade substantially prevents air from entering the third set of channel outlets.

3. The priming device of claim 1, wherein the suction end of the vacuum conduit is substantially shorter in width than an individual print die.

4. The priming device of claim 1, wherein the wiper blade is at least half the width of an individual print die.

5. A method of priming with ink a printbar having a plurality of print dies arrayed a width of the printbar, each print die having a plurality of channel outlets along a print face of the printbar, comprising the steps of:

positioning a suction end of a vacuum conduit opposite a first set of channel outlets of one of the plurality of print dies;

positioning at least one wiper blade adjacent to the suction end of the vacuum conduit along the width of the printbar and opposite a second sheet of channel outlets of the one of the plurality of print dies, such that the wiper blade substantially prevents air from entering the second set of channel outlets;

applying suction to the first set of channel outlets through the suction end of the vacuum conduit; and moving the wiper blade to wipe the second set of channel outlets.

6. The method of claim 5, comprising the additional step of positioning the wiper blade opposite the first set of channel outlets such that the wiper blade wipes excess ink away from the first set of channel outlets.

* * * * *

UNITED STATES PATENT AND TRADEMARK OFFICE

CERTIFICATE OF CORRECTION

PATENT NO. : 5,594,477

DATED : January 14, 1997

INVENTOR(S) : Brian S. HILTON

It is certified that error appears in the above-indentified patent and that said Letters Patent is hereby corrected as shown below:

Claim 1, col 4, line 28, replace "butlers" with --outlets--.

Signed and Sealed this

Eleventh Day of March, 1997

Bruce Lehman

*Attest:*

BRUCE LEHMAN

*Attesting Officer*

*Commissioner of Patents and Trademarks*